US005509662A

United States Patent [19]

Santianni

[11] Patent Number: 5,509,662

[45] Date of Patent: Apr. 23, 1996

[54] METHOD OF PLAYING CHESS

[76] Inventor: Blaise F. Santianni, 807 Glenview St., Philadelphia, Pa. 19111

[21] Appl. No.: 491,085

[22] Filed: Jun. 16, 1995

[51] Int. Cl.[6] ..... A63F 3/02

[52] U.S. Cl. ..... 273/260; 273/262

[58] Field of Search ..... 273/260, 262

[56] References Cited

U.S. PATENT DOCUMENTS

| | | | |
|---|---|---|---|
| 4,856,789 | 8/1989 | Carlson | 273/261 |
| 5,018,744 | 5/1991 | Patracuolia | 273/248 |
| 5,033,753 | 7/1991 | Yuen et al. | 273/261 |
| 5,437,460 | 8/1995 | Cho | 273/262 |
| 5,449,178 | 9/1995 | Castronova | 273/260 |

FOREIGN PATENT DOCUMENTS

| | | | |
|---|---|---|---|
| 2191952 | 12/1987 | United Kingdom | 273/260 |

OTHER PUBLICATIONS

"Chinese Chess For Beginners", Ishi Press International, San Jose, California 95134, 1989.

*Primary Examiner*—Benjamin H. Layno
*Attorney, Agent, or Firm*—John E. Drach

[57] ABSTRACT

Black Hole Chess is a game of tactics and strategy, played on a special board, which is larger than that of conventional chess and having vertical and horizontal grid lines as opposed to columns of alternating colored squares as in conventional chess. There are seventeen pieces representing futuristic, space-age figures on each of two opposing sides. Two players, one for each side, face each other across the board. The object of the game is to maneuver one's pieces, according to prescribed rules, in such a way as to put the opponent's President in a condition of "checkmate" or "stalemate," that is, a situation in which he is threatened with capture and cannot move out of vulnerability in any direction.

8 Claims, 1 Drawing Sheet

METHOD OF PLAYING CHESS

BACKGROUND OF THE INVENTION

1. Field of the Invention

This invention relates to a board game for a pair of opposing players who manipulate movable board pieces in a manner somewhat similar to opponents playing a conventional game of Chess. More specifically, the invention relates to a game played on a special board, larger than that of traditional International chess having vertical and horizontal grid lines as opposed to columns of alternating colored squares and seventeen pieces representing futuristic, space-age figures on each of two opposing sides.

2. Description of the Related Art

A conventional chess game is played on a chessboard, identical to a checkerboard, with thirty-two pieces, one set of sixteen-white, and one set of sixteen-black, for each of two opposing players. The conventional board includes sixty-four squares of two alternating colors, usually white and black or red and black. The playing pieces are ranked with each rank being allowed certain moving privileges in varying patterns along the squares of the playing board. One player each is situated across from the opposing player on each of two opposing sides of the chessboard. These two players, one for each side, face each other across the board, and each player has his own set of playing pieces that are initially arranged in a predetermined order on that player's side of the playing board. The object of the game is to maneuver one's men and pieces, according to prescribed rules, in such a way as to put the most highly-ranked piece, the opponent's king, in a condition of checkmate. Checkmate is a situation in which that king is threatened with capture and cannot move out of vulnerability in any direction.

The present invention relies to a large degree upon a direct correspondence to the pieces, moves and capture strategy of Chinese chess. However, the present invention is an improvement over the Chinese chess game and remains significantly different from the conventional International chess game. It is these areas of departure from Chinese chess and the differences between Black Hole Chess and International chess that characterize the present invention. Because the moves and playing strategy are so affected by the Black Hole, the present invention is an improvement over Chinese chess.

It is therefore, an object of the present invention to improve over Chinese chess and conventional international chess by adding the Black Hole and the special rules peculiar to the Black Hole which in turn affect the moves and the strategy of the present invention.

SUMMARY OF THE INVENTION

The present invention relates to a method of playing a board game of logic and strategy comparable to chess in that it is played by opposing players on opposite sides of a board with playing pieces that are moved by the players in accordance with prescribed rules for both movement and capture in order to try to place the opponent either in a condition of stalemate or checkmate. The game is played on a rectangular playing board having a Black Hole in the shape of a central rectangle, the central long axis of which is coincident with a central axis of the rectangular playing board. The board is covered with nine vertical grid lines and ten horizontal gridlines wherein each of the horizontal grid lines extends from one side of said board to the opposite parallel side of the board. The fifth and sixth horizontal grid lines constitute the long sides of the Black Hole and wherein each of the vertical grid lines extends to each long side of the Black Hole to form a playing board having two large rectangular playing areas, each designated a universe, separated by the Black Hole. Each rectangular playing area is comprised of a grid of lines, also designated lines of force, intersecting at right angles thereby forming 45 grid points. Within each rectangular playing area is a restricted zone, designated as the Presidential Fortress, bounded by the fourth and sixth vertical grid lines and the first and third horizontal grid lines. Two diagonal lines connect the opposite corners of the Presidential Fortress. There are at least thirty four playing pieces divided into two identical sets of seventeen playing pieces per player wherein each set of seventeen pieces is comprised of seven different types of pieces, with each player having a different color set of playing pieces. Each type of piece has a different name. There is one of the first type of piece, preferably designated as the President. There are two Second types of piece each preferably designated as an Orion. There are two Third types of piece each preferably designated as a Laser. There are five Fourth types each preferably designated as an Android. There are two Fifth types each preferably designated as a Ranger. There are two Sixth types each preferably designated as an Isis, and three Seventh types each preferably designated as a Starfighter. The rules of movement for play confine the first type and the Sixth type of pieces to the Presidential Fortress. Each Fourth type of piece is permitted to move through or across the Black Hole. After a fourth type piece has moved through and exits from the Black Hole, that piece suffers "Black Hole Bends" which prevents its player from moving that piece on the player's next turn. After a fourth type piece has moved across or through and exits from the Black Hole, that piece's direction of movement is expanded to left, right, or forward one step at a time. In addition to the fourth type of piece, each of the Second type, Fifth type, and Seventh type pieces is allowed to move across the Black Hole. Each Third type piece is permitted to move up to the Black Hole but cannot cross the Black Hole. At the beginning of the game, one of each player's Seventh type of piece is placed inside the Black Hole and must remain trapped in the Black Hole until freed by a Fourth type piece. A fourth type piece frees the seventh piece trapped in the Black Hole when the fourth type piece has advanced to the last row of its opponent's universe. After the trapped Seventh type piece has been freed, it can move to an unoccupied space on the edge of the Black Hole and suffers Black Hole Bends. Each Seventh type is permitted to capture a target piece only if a third piece lies between the attacking Seventh type and a target piece. Each Fifth type piece moves like the Knight in conventional chess in that it can move along 2 grid points in one direction and then 1 grid point at right angles to the original direction of motion or 1 grid point in one direction and then 2 grid points at right angles to the original direction of motion. Each Fifth type can jump or fly over another piece but it cannot move to an empty space if another piece is immediately in front, behind or on either side at right angles. Each Second type can move vertically and horizontally along any number of unoccupied grid points but can capture a target piece only if there are no other pieces, friend or foe, in its path to the target piece. The game ends when the first type piece is in a condition of stalemate, that is, a situation in which the piece is threatened with capture and cannot move out of vulnerability in any direction.

DESCRIPTION OF THE PREFERRED EMBODIMENTS

Figure 1:
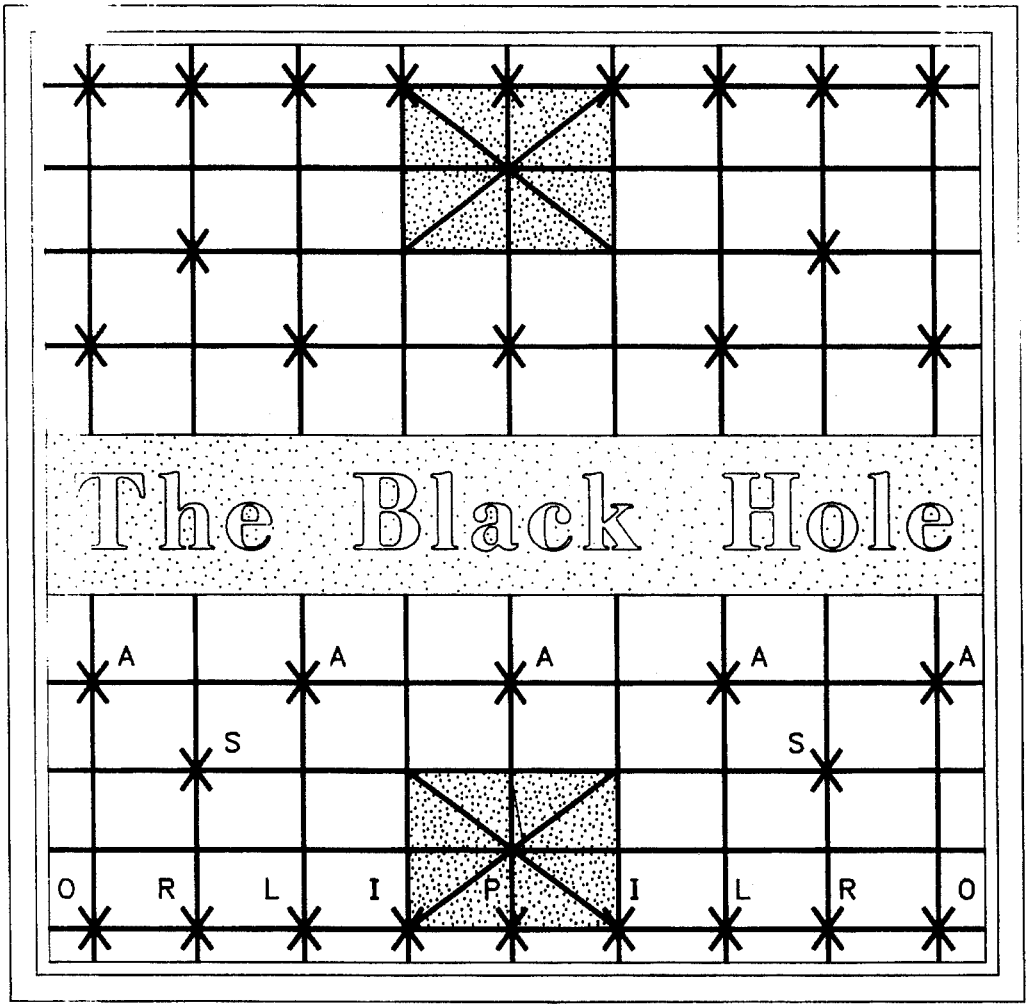
FIG. 1 is a plan view of a playing board in accordance with the invention.

Black Hole Chess is a game of tactics and strategy, played on a special board, which is larger than that of conventional chess and having vertical and horizontal grid lines as opposed to columns of alternating colored squares as in conventional chess. There are seventeen pieces representing futuristic, space-age figures on each of two opposing sides. Two players, one for each side, face each other across the board. The object of the game is to maneuver one's pieces, according to prescribed rules, in such a way as to put the opponent's President in either a condition of "stalemate," that is, a situation in which he is under direct attack but any move he makes with any of his pieces will place him under direct attack or a condition of "checkmate", that is, a situation in which he is threatened with capture and cannot move out of vulnerability in any direction.

The game of Black Hole Chess can best be understood by a comparison to Chinese chess. Black Hole Chess unlike Chinese chess utilizes seventeen pieces most of which have the same moves as Chinese chess pieces while others have markedly different moves. There are also similarities and differences between the board in Black Hole Chess and the board in Chinese chess. The "Black Hole" that spans the width of the board in Black Hole Chess corresponding to a river in the Chinese chess game, but going into the Black Hole subjects pieces to Black Hole Bends whereas crossing the river of the traditional Chinese game is only symbolic and does not affect the piece in question. There is no corresponding area on the board of the International chess game.

The Board

The Black Hole Chessboard of this invention is depicted in FIG. 1 and is a rectangle with nine vertical black grid lines (those running perpendicular to the bottom or near edge of the board) and ten horizontal black gridlines (those running from left to right of the player.) The whole playing area including all the gridlines is enclosed by a dark colored border, preferably black, within which all play takes place. The gridlines span the whole board, visible everywhere except in the Black Hole, which is characterized by having a black color. The sixteen starting positions of all the pieces for each team are marked by a dark colored, preferably black "x" at certain gridline intersections as shown in FIG. 1.

The Black Hole divides the board into two halves or universes, spanning the width of the board, and lying between the fifth and sixth horizontal grid lines, counting from the near edge of each universe. The Black Hole thereby forms a central rectangle, the central long axis of which is coincident with a central axis of the rectangular playing board. The Black Hole is colored black.

Each of the two universes is a different color from the Black Hole and can be a different color from each other. Preferably each universe is colored orange except for the area designated as the Presidential Fortress. The Presidential Fortress is a restricted zone at the near edge of each universe and is bordered by the fourth and sixth vertical grid lines and the first and third horizontal gridlines of each player's universe. The Presidential Fortress is also bisected by two dark, preferably black diagonal lines, which connect the opposite corners. The area inside the Presidential Fortress is a different color from the rest of the board and is preferably green.

The Pieces

There are seven types of pieces comprising a total of seventeen pieces representing futuristic, space-age figures on each of two opposing sides. These seventeen pieces are comprised of one President, two Orions, two Lasers, five Androids, two Rangers, two Ises, and three Starfighters. The first letters of the seven different pieces spell the acronym "POLARIS".

The President corresponds to the King in conventional chess. The President's range of motion is limited to the Presidential Fortress during the course of the game. The President can move within the Presidential Fortress one step at a time in any direction except diagonally. A step is the distance from one grid point to another. The Orion, whose moves are similar to those of the rook of conventional and Chinese chess, can move vertically and horizontally along any number of unoccupied grid points. The Orion cannot jump over another piece. The Laser moves forward or backward along the diagonals, two grid points at a time but cannot enter or cross the Black Hole nor can it jump other pieces. The movements of the Laser correspond to the elephant in Chinese chess. The five Androids loosely correspond to the eight pawns per side in International chess and the five pawns per side in Chinese chess. Each of the five Androids is deployed across the fourth grid line of each universe, one gridline shy of the Black Hole. The Android moves forward one grid line at a time in the home universe. The Android's movement possibilities change once it crosses the Black Hole. After crossing the Black Hole, the Android can move sideways or move forward one grid line at a time. The Android can cross or go into the Black Hole but only on the second or subsequent move. The Android has two options when crossing the Black Hole. In a first option, the Android can move directly across the Black Hole to the corresponding grid line on the opposite side of the Black Hole in one move. In a second option, the Android can go into the Black Hole and land on any unoccupied grid point along the hostile frontier. If the second option of going into the Black Hole is chosen, the Android experiences a time warp and suffers the Black Hole Bends. The Black Hole Bends is a penalty for going into the Black Hole which results in the immobilization of the Android during the player's next turn thereby leaving the Android vulnerable to capture by the opposing player. The Ranger's moves are very similar to those of the knight in conventional chess in that the Ranger's net move is always in the shape of an "L". However, the rules of engagement for the Ranger prescribe that it move one gridpoint along either vertical or horizontal grid lines in any direction and then move at a 45° angle one more grid point. The Ranger's moves are subject to limitations as described later. The Isis protects the President and corresponds to the guard in Chinese chess. The Isis has no counterpad in conventional chess. The Isis moves only along a diagonal, one grid point at a time and is confined to the Presidential Fortress. The Starfighter moves like the Orion but must fly over a piece in order to capture it. The Starfighter corresponds to the Cannon in Chinese chess but has no counterpad in conventional chess. The Starfighter moves like the Orion but must fly over a piece in order to capture a target piece. There can be one and only one piece between the Starfighter and the piece the Starfighter captures. Ideally, one set of opposing pieces is of a different color from the other set. Preferably, one set is dark colored and the other set is light colored. Most preferably, pieces are colored midnight blue for one team and silver for the other team.

Moves and Powers

Players familiar with the Chinese chess game will recognize that all moves and rules of engagement, and thus attacking strategies of the pieces in Black Hole chess equally correspond to the pieces in the Chinese chess game.

Players familiar with International chess will recognize that the Androids have similar moves to the traditional pawn, but there are vast differences as well. Like Pawns in International chess, Androids in their own universe can only move forward one grid point at a time and cannot move on the diagonal. But Androids cannot be moved two grid points on their initial move, nor can they attack on a diagonal like pawns in International chess. Once Androids enter the Black Hole and subsequently the enemy universe, the similarities to pawns decrease dramatically.

Crossing the Black Hole constitutes one move by the Android, but opting to travel 'through' the Black Hole and thus having the luxury of emerging on any open gridpoint along the enemy universe's frontier with the Black Hole subjects the Android to Black Hole Bends. Black Hole Bends affects Androids who opt to 'travel' through the Black Hole. An Android that 'travels' through the Black Hole is immobilized for one full turn, leaving it vulnerable to attack during two of an opponent's turns. This is not to say that a player who chooses to send an Android through the Black Hole loses a turn. It only means that during that player's next turn, the player cannot move the Android, but must move another piece instead. Once in the enemy's universe, the Android becomes a more potent force than the pawn of International chess. In the enemy universe, the Android can move and attack, one gridpoint at a time, in all directions along the vertical and horizontal grid lines except backwards. Also, similar to one of the functions of the pawn in International chess, if the Android reaches the last gridline of the enemy universe (the one that traverses the base of the enemy Presidential Fortress) the Starfighter belonging to that player is available for release. The Android which reaches the last rank remains in play or is taken off the board if its player chooses to release the trapped Starfighter.

The Starfighter is probably the most complex piece on the board. The Starfighter literally flies through space as its complement does in the ancient Chinese chess game. The Starfighter can move along vertical or horizontal grid lines as far as possible as long as no other piece is in its path, but the Starfighter can only attack if a single piece (friend or foe)lies between it (the Starfighter) and its prey. For instance, moving an Android through the Black Hole to a different gridline on the enemy's frontier creates two beneficial possibilities. One, it could suddenly change the prey of a Starfighter aligned on the Android's previous gridline and two, the Android's new location could serve as the necessary piece between a Starfighter and an enemy for an attack. This kind of strategy is similar to hidden check in International chess where moving one piece subjects the opponents King to check by another piece.

When an Android reaches the last grid line of an opponent, the trapped Starfighter for the same team is eligible for release. The Android is immediately taken off the board and it is up to the player when to put that Starfighter into play. When put into play, the Starfighter can be placed on any gridpoint along either side of the Black Hole, which constitutes a single move, and that Starfighter suffers from the Black Hole Bends just as the Android does when 'travelling' through the Black Hole. There is no corresponding rule in Chinese chess.

The Ranger has the same moves as the Knight in International chess, but the rules of engagement for the Ranger differ slightly from the Knight in International chess. The Ranger appears to make the same "L"- shaped move as the Knight in chess,: two gridpoints in any vertical or horizontal direction, then one gridpoint in any vertical or horizontal direction that forms a right angle with the first direction. But in fact only the end result of its move is the same. The Ranger actually moves one gridpoint along either vertical or horizontal grid lines in any direction and then moves at a 45° angle one more grid point. But whereas the Knight in International chess can leap any piece which lies in its path in order to move or attack another piece, the Ranger can not leap any piece. In other words, if there is a piece, friend or foe, on any one of the four points around the Ranger, the Ranger cannot move or attack in those directions.

The Orion has the same moves and rules of engagement as the Rook in International chess, the only difference being that whereas the Rook in chess may 'castle' with the King, the Orion does not have this option. To summarize, the Orion may move forward or backward or laterally in any direction, as far as desired, so long as it passes only over vacant squares in a straight line.

The Laser moves at a 45° angle relative to either grid line on which it is deployed, two gridpoints at a time. The Laser cannot jump pieces nor can it cross the Black Hole. The Laser can only attack and capture a piece which is deployed on the same gridpoint at which a Laser's move would come to an end, and no piece lies between the Laser and its prey. Because of their symmetrical moving patterns, there are only seven fixed points in each universe that a team's Lasers may occupy.

The Isis protects the President. It can only move along the drawn diagonal lines within the Presidential Fortress, one gridpoint at a time, forwards or backwards. The Isis may attack and capture any piece which moves onto any one of the five gridpoints in the Presidential Fortress to which the Isis has access.

The President is confined to the Presidential Fortress during the course of the game and can only move one gridpoint at a time in any direction except diagonally. The President may capture any piece which moves onto any one of the nine gridpoints that make up the Presidential Fortress as long as in doing so, the President does not leave itself vulnerable to attack or put itself into check. In the enemy universe, the Android can move and attack, one gridpoint at a time, in all directions along the vertical and horizontal grid lines except backwards. Also, similar to one of the functions of the pawn in International chess, if the Android reaches the last gridline of the enemy universe (the one that traverses the base of the enemy Presidential Fortress) the Starfighter belonging to that player is available for release.

The Starfighter is probably the most complex piece on the board. The Starfighter literally flies through space as its complement does in the ancient Chinese chess game. The Starfighter can move along vertical or horizontal grid lines as far as possible as long as there are no other pieces in its path, but the Starfighter can only attack if a single piece (friend or foe) lies between it (the Starfighter) and its prey. For instance, moving an Android through the Black Hole to a different gridline on the enemy's frontier creates two beneficial possibilities. One, it could suddenly change the prey of a Starfighter aligned on the Android's previous gridline and two, the Android's new location could serve as the necessary piece between a Starfighter and an enemy for an attack. This kind of strategy is similar to hidden check in International chess where moving one piece subjects the opponents King to check by another piece.

When an Android reaches the last grid line of an opponent, the trapped Starfighter for the same team is eligible for release. It is up to the player whether and when to put that Starfighter into play. When put into play, the Starfighter can be placed on any gridpoint along either side of the Black Hole, which constitutes a single move, and that Starfighter suffers from the Black Hole Bends just as the Android does when 'travelling' through the Black Hole. There is no corresponding rule in Chinese chess. In some situations it may be more advantageous for the player not to give up his Android to free a trapped Starfighter. Since the Android is already deep into enemy territory, it may be better to attack the enemy President with the Android than to free the Starfighter who must come out of the Black Hole and then suffer Black Hole Bends. As a result, the player has the option of not freeing the trapped Starfighter. This option presents itself once for each Android that safely reaches the last row of the hostile universe. When this happens, the player must immediately decide whether to take the Android off the board, indicating that the player is freeing the Starfighter, or leave the Android on the board.

The Ranger has the same moves as the Knight in International chess, but the rules of engagement for the Ranger slightly differ from the Knight in International chess. The Ranger appears to make the same "L"- shaped move as the Knight in chess,: two gridpoints in any vertical or horizontal direction, then one gridpoint in any vertical or horizontal direction that forms a right angle with the first direction. But in fact only the end result of its move is the same. The Ranger actually moves one gridpoint along either vertical or horizontal grid lines in any direction and then moves at a 45° angle one more grid point. But whereas the Knight in International chess can leap any piece which lies in its path in order to move or attack another piece, the Ranger can not leap any piece. In other words, If there is a piece, friend or foe, on any one of the four points around the Ranger, the Ranger cannot move in those directions.

The Orion has the same moves and rules of engagement as the Rook in International chess, the only difference being that whereas the Rook in chess my 'castle' with the King, the Orion does not have this option. To summarize, the Orion may move forward or backward or laterally in any direction, as far as desired, so long as it passes only over vacant squares in a straight line.

The Laser moves at a 45° angle relative to either grid line on which it is deployed, two gridpoints at a time. The Laser cannot jump pieces nor can it cross the Black Hole. The Laser can only attack and capture a piece which is deployed on the same gridpoint at which a Laser's move would come to an end, and no piece lies between the Laser and its prey. Because of their symmetrical moving patterns, there are only seven fixed points in each universe that a team's Lasers may occupy.

The Isis protects the President. It can only move along the drawn diagonal lines within the Presidential Fortress, one gridpoint at a time, forwards or backwards. The Isis may attack and capture any piece which moves onto any one of the five gridpoints in the Presidential Fortress to which the Isis has access.

The President is confined to the Presidential Fortress during the course of the game and can only move one gridpoint at a time in any direction except diagonally. The President may capture any piece which moves onto any one of the nine gridpoints that make up the Presidential Fortress as long as in doing so, the President does not leave itself vulnerable to attack or put itself into check.

Rules of Engagement

Before the beginning of play, the two players may agree on which is to take the dark colored and which the light colored pieces. Or one player may take a piece of one color in one hand and a piece of the other color in the other hand, and then let the other player point to one of those hands and take whichever color happens to be in that hand.

The player having the lighter colored piece always makes the first move. Thereafter each player in turn moves a piece. As noted, an Android may capture any enemy piece that is on a square immediately in front of it in its own universe and that is immediately one gridpoint in front, to the right of or to the left of it in the enemy universe. The Starfighter, Orion, Ranger, Laser, Isis and President may capture any opponent that occupies any gridpoint to which it is entitled to move by its prescribed moves. As noted before, one piece, friend or foe, must lie between the Starfighter and its prey in order for the Starfighter to capture its prey.

A move is completed when a player, having moved a piece to another gridpoint, removes his or her hand from the piece. Thereafter it cannot be retrieved or touched again until another turn. However, if a player wants to correct the position of a piece so that it will stand properly on the gridpoint, he or she may do so with agreement from their opponent.

But, as long as a player's hand remains on the piece in question, that player has the option of returning the piece to its original starting point during that turn and then move a different piece. The length of time during which a player may leave a hand on a moved piece should be decided between the two players themselves.

If one player's Android moves all the way across the board to the opponents first grid line, the one that traverses the base of the opponents Presidential Fortress, the trapped Starfighter belonging to the player who moved the Android becomes eligible for release at any time during any one of that player's subsequent moves.

When a piece comes into a position to threaten directly the capture of the President, the President is said to be 'in check' and this must be announced. A President may not be moved into check. All enemy pieces put a President in check the same way that they threaten the capture of any other piece.

The President never can actually be captured, but when the President is brought into check by any opposing piece, the President must move from the gridpoint that it occupies (either to a vacant gridpoint or by capturing an opponent on an adjacent gridpoint), be screened from check by the interposition of one of the President's own pieces, or by removing one of its own pieces from the line of attack if the attacking piece is an enemy Starfighter, or the attacking piece must be captured by one of the president's pieces.

Ending the Game

If the President is brought into check and none of the President's pieces can come to the President's rescue, and the President cannot move to any other gridpoint either because it is occupied by one of the President's own pieces, or because the President would be moving into check, or the President's own piece is unable to move itself out of the attacking path of an enemy Starfighter, the President is in "checkmate". That situation ends the game, and the player whose President has been checkmated is the loser.

If the President is not in check, but its owner has no move left other than one that would place the President in check, it is 'stalemate,' and the game ends in a victory for the attacking player. A stalemate occurs when the President is not under check and the President cannot move to a safer position and the player has no other piece to move.

There are many stalemates in Black Hole Chess because of the rule of play that the two Presidents can never face each other. No move can be made by either player which leaves the two Presidents facing each other in a face off. If either player has one piece that lies between the two presidents that piece cannot be moved from between the presidents.

When the President is under direct attack, the attacking player exclaims "check". The President must then be moved to a safe position inside the presidential fortress or the attack must be blocked. When the attacking player maneuvers the President to a position where the President cannot move out of check or block the attack then the President is checkmated and the game is over.

What is claimed is:

1. A method of playing a board game of logic and strategy comparable to chess in that it is played by opposing players on opposite sides of a board with playing pieces that are moved by the players in accordance with prescribed rules for both movement and capture in order to try to place the opponent in a condition of checkmate or stalemate, said method comprising the steps of: (1) providing a rectangular playing board having a Black Hole in the shape of a central rectangle, the central long axis of which is coincident with a central axis of said rectangular playing board; (2) covering said board with nine vertical grid lines and ten horizontal gridlines wherein each of said horizontal grid lines extends from one side of said board to the opposite parallel side of said board and wherein the fifth and sixth of said horizontal grid lines constitute the long sides of said central rectangle and wherein each of said vertical grid lines extends to each long side of said central rectangle to form a playing board having two large rectangles separated by said central rectangle and wherein each large rectangle is comprised of a grid of lines intersecting at right angles thereby forming 45 grid points; (3) establishing in each of said large rectangles a restricted zone bounded by the fourth and sixth vertical grid lines and the first and third horizontal grid lines and having two diagonal lines connecting opposite corners of said restricted zone; (4) allocating a total number of at least thirty four playing pieces for said game; and dividing said thirty four playing pieces equally into two identical sets of seventeen playing pieces per player wherein each set of seventeen pieces is comprised of seven different types of pieces, with each player having a different color set of playing pieces; (5) designating each set of playing pieces to include one First type, two Second type, two Third type, five Fourth type, two Fifth type, two Sixth type, and three Seventh types; (6) formatting predetermined rules of movement for play wherein the First type and the Sixth type are permitted movement within said restricted zone only; (7) formatting predetermined rules of movement for play wherein each Fourth type is permitted movement through or across the Black Hole; (8) formatting predetermined rules of movement for play wherein prior to moving through the Black Hole each Fourth type is restricted to move forward one step at a time; (9) formatting predetermined rules of movement for play wherein after a Fourth type has moved through the Black Hole said Fourth type is permitted to move left, right, or forward one step at a time; (10) formatting predetermined rules of movement for play wherein a Fourth type is prohibited movement on its players next turn after said fourth type has moved through said Black Hole; (11) formatting predetermined rules of movement for play wherein each of the Second type, Fifth type, and Seventh type pieces is permitted movement across said Black Hole; (12) formatting predetermined rules of movement for play wherein each Third type is permitted movement up to the Black Hole but is prohibited from crossing the Black Hole; (13) formatting predetermined rules of movement for play wherein when play begins, one of each player's Seventh type of piece is inside the Black Hole and is constrained to the Black Hole until freed by a Fourth type which has advanced to the last row of its opponent's side of the board; (14) formatting predetermined rules of movement for play wherein after said Seventh type of step (13) has been freed, said Seventh type is permitted movement to an unoccupied space on the edge of the Black Hole and is also prohibited movement on its players next turn and said Fourth type of piece in step (13) is removed from the board; (15) formatting predetermined rules of movement for play wherein each Seventh type is permitted to capture a target piece only if a third piece lies between said Seventh type and said target piece; (16) formatting predetermined rules of movement for play wherein each Fifth type is permitted movement one gridpoint along either vertical or horizontal grid lines in any direction and then one additional grid point at a 45° or 225 ° angle to the original direction of motion; (17) formatting predetermined rules of movement for play wherein each Fifth type is permitted movement over another piece; (18) formatting predetermined rules of movement for play wherein each Fifth type is prohibited from movement to a permissible space if another piece is immediately in front, behind or on either side of said Fifth type; (19) formatting predetermined rules of movement for play wherein each Second type is permitted movement vertically and horizontally along any number of unoccupied grid points and is permitted to capture a target piece only if the path to said target piece is clear.

2. The method of claim 1 wherein said first type piece is designated the President.

3. The method of claim 1 wherein each of said second type piece is designated an Orion.

4. The method of claim 1 wherein each of said third type piece is designated a Laser.

5. The method of claim 1 wherein each of said fourth type piece is designated an Android.

6. The method of claim 1 wherein each of said fifth type piece is designated a Ranger.

7. The method of claim 1 wherein each of said sixth type piece is designated an Isis.

8. The method of claim 1 wherein each of said seventh type piece is designated a Starfighter.

* * * * *